US010859351B1

(12) United States Patent
Bolduc

(10) Patent No.: US 10,859,351 B1
(45) Date of Patent: Dec. 8, 2020

(54) PORTABLE DISPOSABLE FIREWORKS LAUNCH PLATFORM

(71) Applicant: Tim Bolduc, Sabattus, ME (US)

(72) Inventor: Tim Bolduc, Sabattus, ME (US)

( * ) Notice: Subject to any disclaimer, the term of this patent is extended or adjusted under 35 U.S.C. 154(b) by 0 days.

(21) Appl. No.: 16/824,845

(22) Filed: Mar. 20, 2020

Related U.S. Application Data

(60) Provisional application No. 62/902,986, filed on Sep. 20, 2019.

(51) Int. Cl.
*F42B 4/20* (2006.01)
*F42B 4/00* (2006.01)

(52) U.S. Cl.
CPC . *F42B 4/20* (2013.01); *F42B 4/00* (2013.01)

(58) Field of Classification Search
CPC ..... F42B 4/00; F42B 4/20; F42B 4/26; F42B 4/30
USPC ..... 102/343, 349, 358; 248/205.3, 683
See application file for complete search history.

(56) References Cited

U.S. PATENT DOCUMENTS 1,667,180 A * 4/1928 Willson ..... F42B 4/18 102/355
2,142,227 A * 1/1939 Whiteside ..... F42B 39/00 102/361
2,914,873 A * 12/1959 Brennan ..... G09F 7/12 40/594
4,050,579 A * 9/1977 Gorski ..... B65B 17/025 206/460
4,748,125 A * 5/1988 Pizzolante ..... B01L 9/06 206/460
5,016,853 A * 5/1991 Cox ..... A47G 33/12 248/174
6,182,422 B1 * 2/2001 Andersen ..... B65B 15/00 53/442
7,287,474 B2 * 10/2007 Whitley ..... F42B 4/20 102/335
7,314,005 B2 * 1/2008 Deye ..... F42B 4/00 102/356
8,302,806 B1 * 11/2012 Gibbar ..... A47G 23/0216 220/738
8,365,667 B2 * 2/2013 Marietta ..... F42B 4/00 102/358
2007/0125919 A1 * 6/2007 Hopkins ..... C08J 9/00 248/205.3

* cited by examiner

*Primary Examiner* — James S Bergin
(74) *Attorney, Agent, or Firm* — Jeffrey Joyce, Esq.

(57) ABSTRACT

A portable, disposable, fireworks launch platform device that has a base member that includes an adhesive for securing one or more fireworks in a desired launching position as fireworks are launched.

6 Claims, 5 Drawing Sheets

PORTABLE DISPOSABLE FIREWORKS LAUNCH PLATFORM

BACKGROUND INFORMATION

Field of the Invention

The invention relates to devices that are used to safely launch fireworks, and in particular platforms that stabilize fireworks as they are being launched into the air.

Discussion of Prior Art

Fireworks are a class of low explosive pyrotechnic devices that are used for entertainment purposes. Large fireworks displays are common during holidays and significant events, which are often arranged and carried out by professional pyro technicians. However, in many areas fireworks are also commercially available to any consumer. These devices are used for personal entertainment, often at parties and family gatherings to celebrate any number of events. Commercial fireworks tend to be smaller than display fireworks, often being contained in and launched from tubes that are several inches in height and sometimes grouped in racks.

Grouping a number of launch tubes together allows the user to create a more impressive display relative to an individual firework. However, as the tubes typically have significantly longer length than width they are somewhat unstable while in a vertically oriented firing position. As a result, it is not uncommon for them to tip or fall to the side while launching. This is a dangerous scenario in any situation, but is even more dangerous when a group of fireworks are being launched at the same time. In such a situation multiple fireworks may be fired into a crowded area, a wooded area, or into any number of homes and buildings.

What is needed, therefore, is a device that secures fireworks in the proper firing position. What is further needed, is such a launching device that is easy to move about and to dispose of.

BRIEF SUMMARY OF THE INVENTION

The invention is a portable, disposable, fireworks launch platform that has a flat base that is relatively wide compared to the average fireworks tube and that has an adhesive on at least a portion of an upper surface. The adhesive area is initially covered by a non-adhesive removable member. When a user is ready to use the device the non-adhesive removable member is peeled off of the adhesive portion and one or more fireworks tubes are secured to the adhesive area. While the size and shape of the device may vary, and while fireworks come in various shapes and sizes, it is likely that multiple fireworks may be secured to a single device.

To use the fireworks, a user places the fireworks device on the adhesive, which secures the firework in the properly oriented position and continues to hold it in place as the fireworks are launched. The platform is relatively thin and light and has, at least, a small portion that does not have adhesive such that a user is able to easily move it form one place to another. After the firework display has finished the device may be safely transported by a user holding it away from his/her body to a watering source to drench both the fireworks and the device with water and then dispose of both.

Additional securing members may also be provided. For example, in one embodiment the outer edge of the device is comprised of rectangular tabs that may be separated from the side, bent, for example at approximately 90 degrees into an approximate L-shape, and then placed on the adhesive beside the firework to further secure it. In another embodiment, small blocks are provided that may be secured to the adhesive beside the fireworks.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
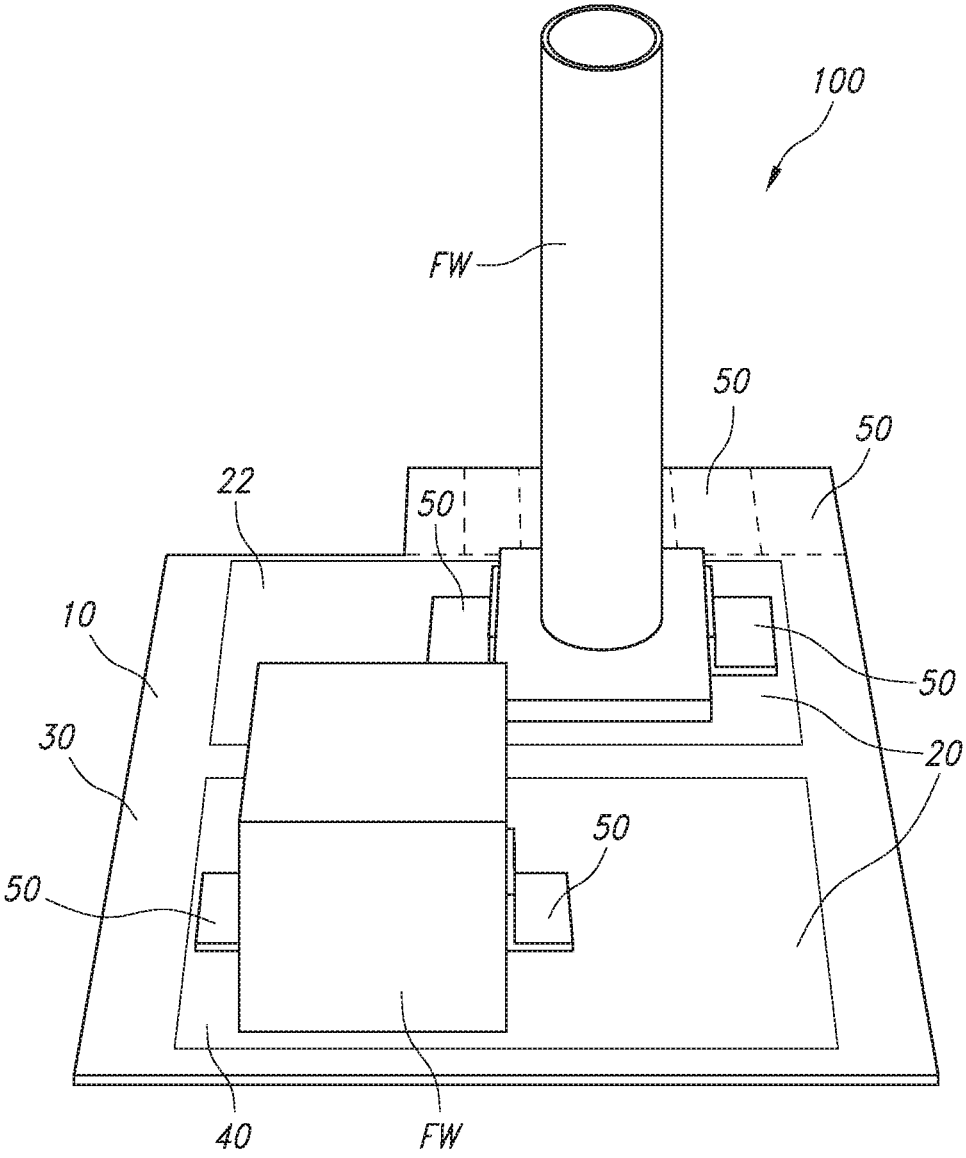
FIG. 1 is a perspective view of the device according to the invention showing the top and side of the device having two firework devices secured to the device.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-6 illustrate a portable disposable fireworks launch platform 100 according to the invention, including a relatively flat base member 10, an adhesive area 20, and a non-adhesive area 30. An adhesive 22, which may or may not be visible, is applied to the adhesive area 20. In use, conventional fireworks FW may be placed on the adhesive area where they are secured in the proper position by the adhesive 22. The adhesive is strong enough to cause the fireworks to maintain their position during launch.

While the size, shape and materials may vary, one suitable embodiment is an approximately square shape measuring approximately 16 inches in width by 16 inches in length. This embodiment is easily transported and moved about as the user adds fireworks to one or more devices 100 to create a fireworks display. Multiple launch tubes and/or racks may be secured to the adhesive area 20 by the adhesive 22, which secures the fireworks FW in such a manner that they will maintain the proper position during launch. Once the fireworks FW are launched the device 100 may be disposed of, for example, by a user carrying the device 100 by holding the non-adhesive area 30 while extending the device 100 away from his/her body to a watering source that may drench the device in water to ensure all fire/heat is extinguished and then placed in a conventional trash/garbage bin.

Figure 5:
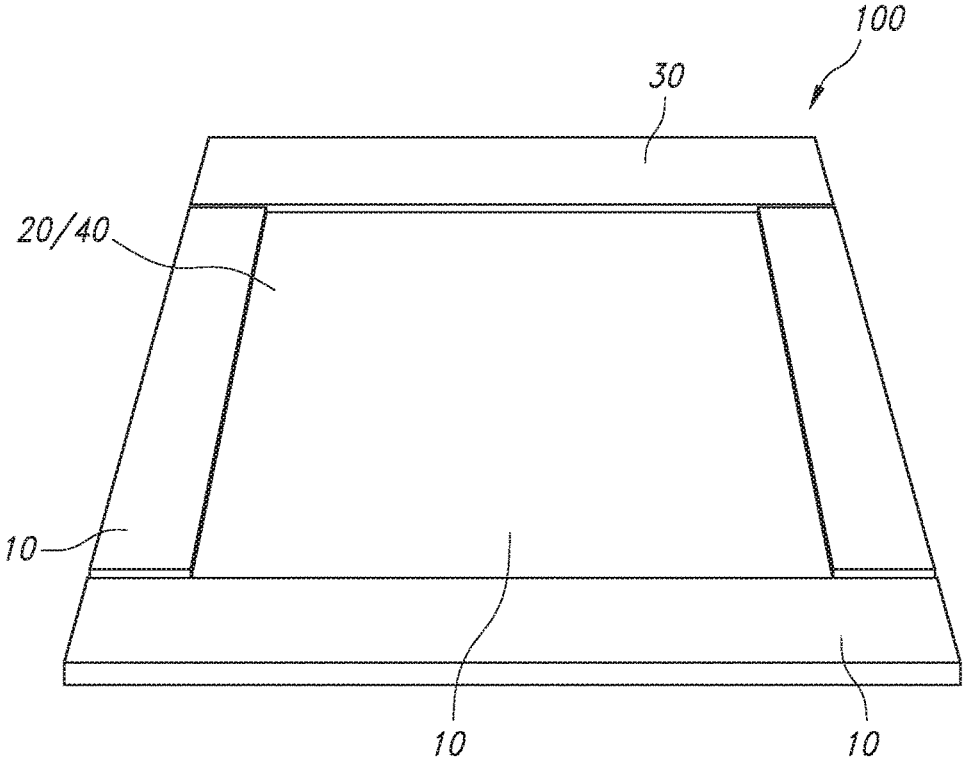
FIG. 5 is a top view of the device.
Figure 6:
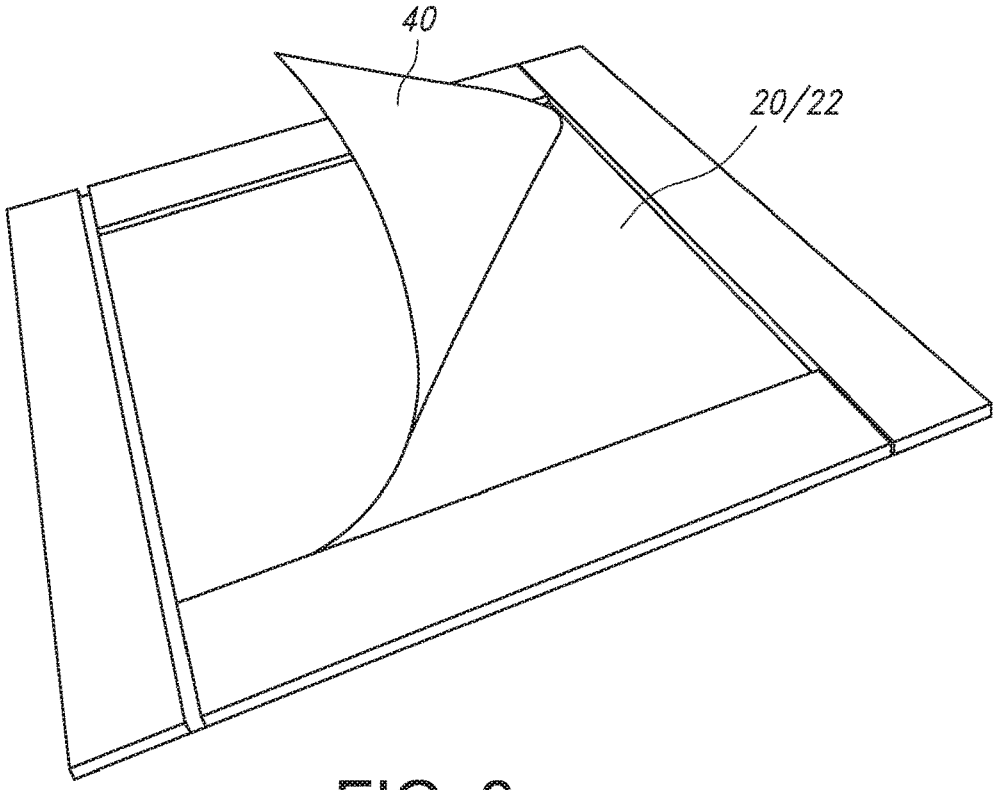
FIG. 6 is a top view of the device with an adhesive cover partially removed.

An adhesive cover 40 that removeably adheres to the adhesive 22 may be placed over the adhesive area 20 until a user is ready to use the device 100 to prevent other objects from unintentionally adhering to the surface 20. The adhesive cover 40 may be made of any suitable conventional material that is known to adhere to but be separable from the adhesive. The non-adhesive area 30 is at least large enough to allow a user to easily pickup and carry the device 100. For example, the non-adhesive area 30 may be the entire outer edge as shown in FIGS. 5 and 6, or it may be a smaller area. In the example of a 16×16 inch device, the non-adhesive area 30 may be an outer edge that measures 2 inches in width.

Support members 50 are also provided and may be placed around the fireworks FW to provide additional support for the fireworks FW, the support members 50 also being secured to the device 100 by the adhesive. The support members 50 provide additional support for any type of fireworks, but are particularly advantageous with relatively tall tubes as these types of devices are more prone to tipping or falling during launch.

Figure 2:
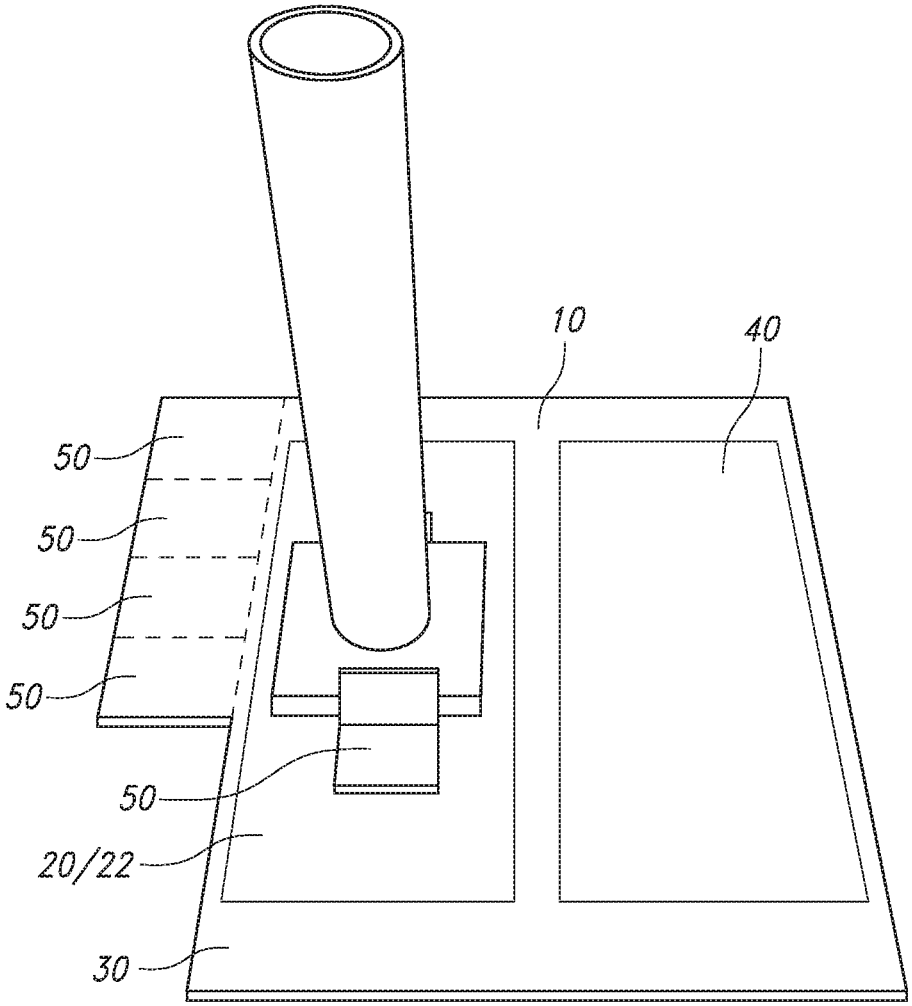
FIG. 2 is a perspective view of the device according to the invention showing the top and end of the device having one firework tube secured to the device.
Figure 3:
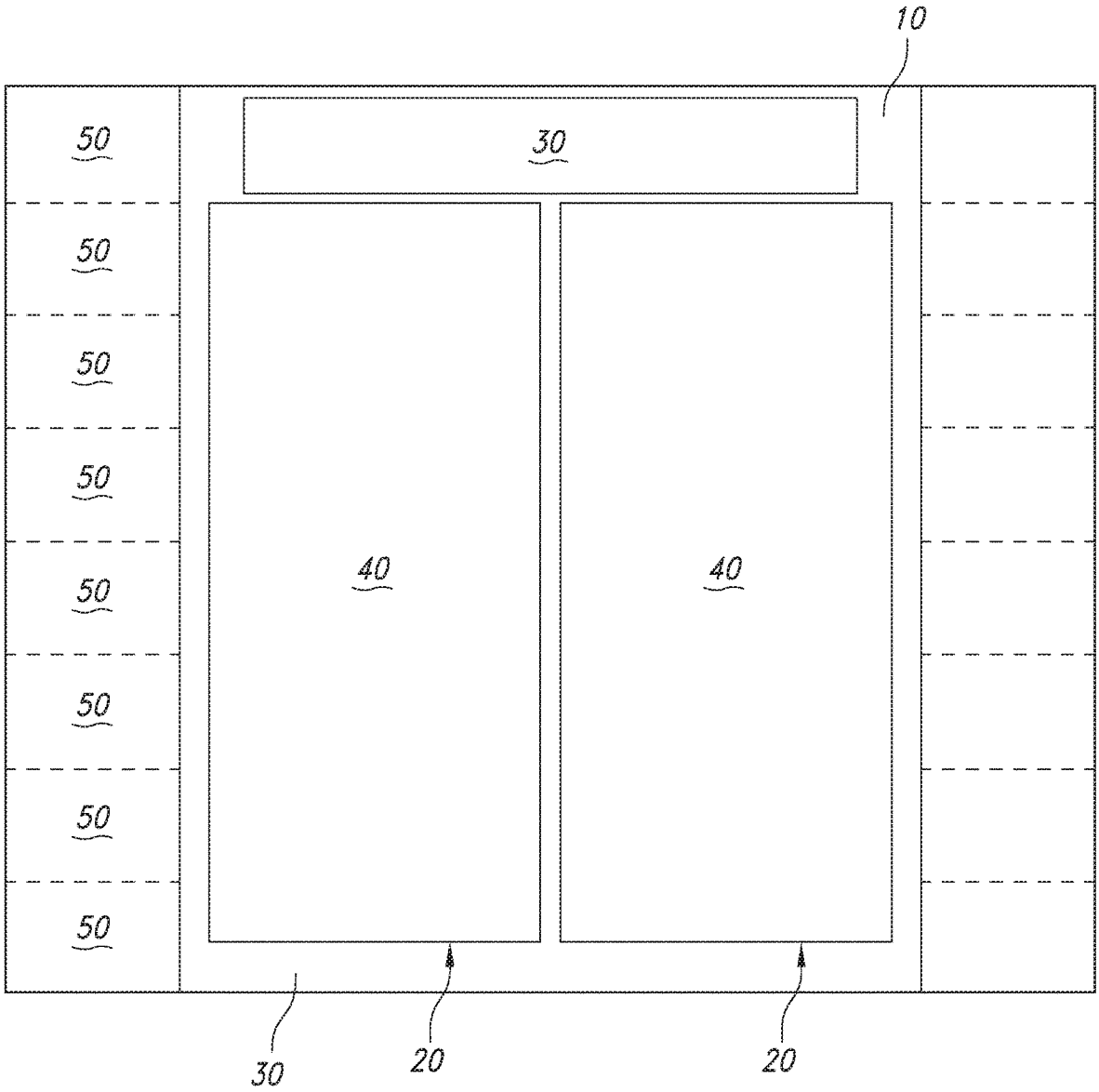
FIG. 3 is a top view of the device.

In the embodiment shown in FIGS. 1-3 the support members 50 are initially formed as a part of the base member 10, having non-adhesive surfaces and having perforations that allow a user to tear the support member 50 from the base 10, after which the support member is bent roughly 90 degrees to an approximate L-shape. The support members 50 are then placed on the base member 10 next to the fireworks FW with one side firmly affixed to the adhesive 22 and the other side pressing against the firework.

Figure 4:
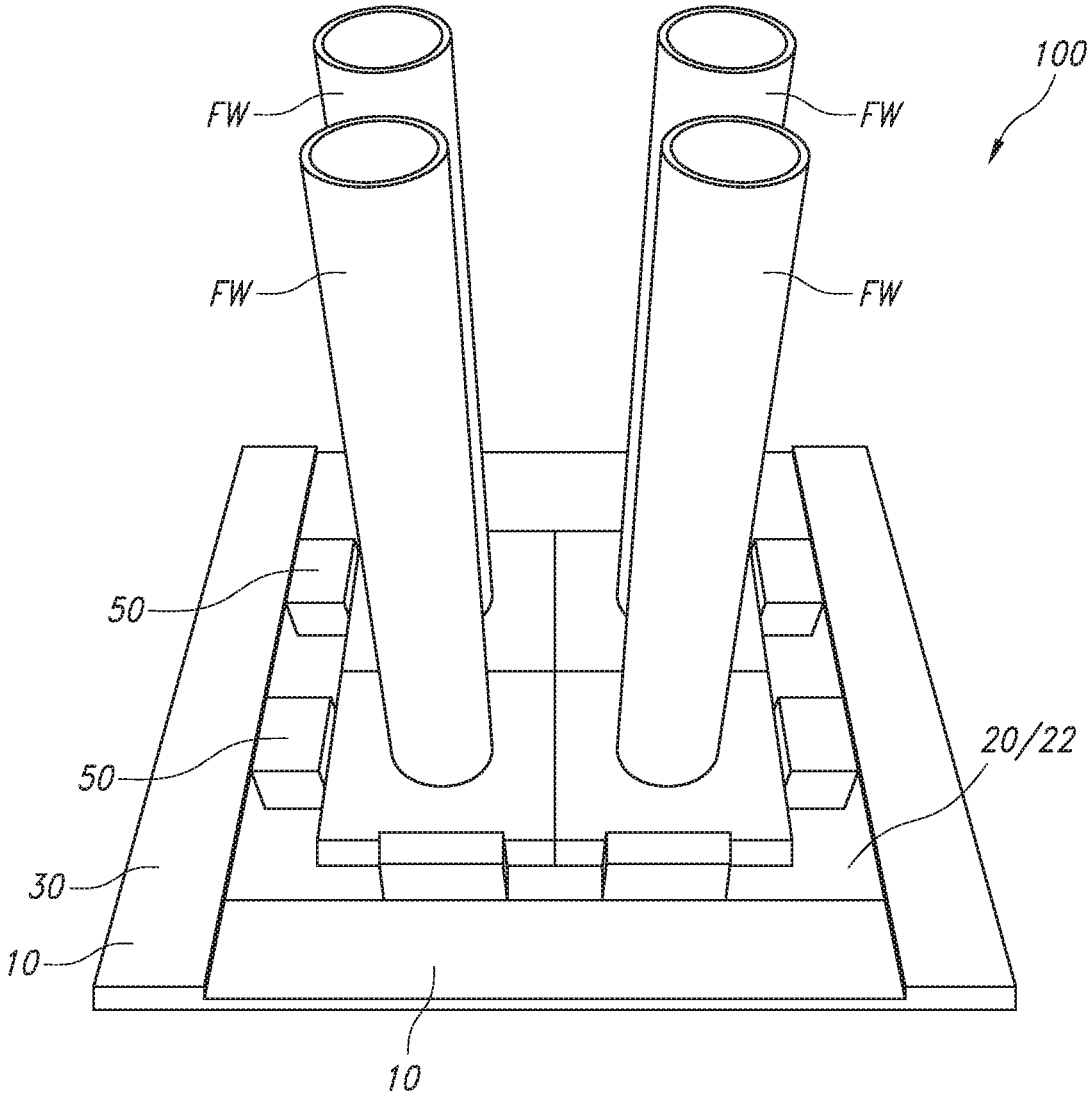
FIG. 4 is a perspective view of the device according to the invention showing the top and front of the device having four firework launch tubes secured on to the device.

Alternatively, FIG. 4 illustrates one embodiment where the support members 50 are blocks that have a roughly rectangular shape. In the example of a platform that measures 16 inches×16 inches suitable support members may be ¾ inch high by ¾ inch wide by 2 inch long. These may be made of any suitably strong but light material, such as, for example, cardboard or a relatively sturdy foam. Again, they are placed directly beside and/or around the base of the firework FW and affixed to the adhesive.

The base member 10 may be made of any suitably sturdy but light material, such as cardboard or corrugated fiberboard.

Similarly, there are many suitable materials that may be used for the adhesive. Conventional examples include double sided transfer tape and glues. For example, the 9088R Adhesive Tape may be 3M.

It is understood that the embodiments described herein are merely illustrative of the present invention. Variations in the construction of the portable disposable fireworks launch platform may be contemplated by one skilled in the art without limiting the intended scope of the invention herein disclosed and as defined by the following claims.

What is claimed is:

1. A portable disposable firework launch platform device adapted to secure fireworks in a launching position, the portable disposable firework launch platform device comprising:

a base member having an adhesive area, the adhesive area having an adhesive;

support members that are configured to be placed on the adhesive area near the fireworks to further secure the fireworks in the launching position, the support members being tabs that are formed as a part of the base member having one or more perforations that allow a user to remove the tabs from the base, the support members further being bendable such that the user may bend the support member into a shape having two sides, the two sides including a first side that secures to the adhesive and a second side that is positioned near the firework;

and wherein placing the fireworks on the adhesive area secures the fireworks in the launching position as the fireworks are being launched.

2. The device of claim 1, the base member further including a non-adhesive area.

3. The device of claim 2, wherein the non-adhesive area is an outer edge of the base member.

4. The device of claim 1, further including an adhesive cover that is removably attached to the adhesive area.

5. The device of claim 1, wherein the base member is made of cardboard.

6. The device of claim 1, wherein the adhesive is a double-sided tape.

* * * * *